United States Patent [19]

Fischer

[11] 4,148,256

[45] Apr. 10, 1979

[54] INKING SYSTEM FOR LITHOGRAPHIC OFFSET PRINTING MACHINES

[75] Inventor: Hermann Fischer, Augsburg, Fed. Rep. of Germany

[73] Assignee: Maschinenfabrik Augsburg-Nürnberg Aktiengesellschaft, Augsburg, Fed. Rep. of Germany

[21] Appl. No.: 872,913

[22] Filed: Jan. 27, 1978

[30] Foreign Application Priority Data

Jan. 28, 1977 [DE] Fed. Rep. of Germany ..... 2703425

[51] Int. Cl.[2] ..... B41F 31/14; B41F 31/26; B41F 35/04; B41F 31/30

[52] U.S. Cl. ..... 101/350; 101/148; 101/DIG. 6

[58] Field of Search ..... 101/350, 351, 352, 363, 101/364, 147, 148, 141, 142, 207, 208, 210, 423, 425

[56] References Cited

U.S. PATENT DOCUMENTS

| | | | |
|---|---|---|---|
| 2,223,945 | 12/1940 | Barber | 101/350 |
| 2,690,119 | 9/1954 | Black | 101/148 |
| 4,033,262 | 7/1977 | Johne et al. | 101/350 |

FOREIGN PATENT DOCUMENTS

| | | | |
|---|---|---|---|
| 488444 | 7/1958 | United Kingdom | 101/147 |
| 957533 | 5/1964 | United Kingdom | 101/148 |

*Primary Examiner*—J. Reed Fisher
*Attorney, Agent, or Firm*—Flynn & Frishauf

[57] ABSTRACT

To prevent splashing off of water and ink emulsion from rollers in the inking system due to feedback of wetting water to the inking system, a roller of the inking system, preferably an ink supply roller accepting ink from a ductor roller, is associated with a return roller which accepts the water-ink emulsion, and a stripping arrangement which strips off that emulsion from the return roller returns the emulsion to the ink well or ink trough of the ink supply system. The stripping element may be the ductor roller itself, rotating in counter direction to rotation of the return roller, intermediate rollers in counter-rotation with respect to the ductor roller, or doctor blades, or the like.

21 Claims, 8 Drawing Figures

INKING SYSTEM FOR LITHOGRAPHIC OFFSET PRINTING MACHINES

The present invention relates to an inking system for lithographic offset printing machines, and more particularly to an inking system for rotary offset printing machines operating, for example, at high speed, in which a ductor roller provides printing ink to an ink train of the inking system.

BACKGROUND AND PRIOR ART

Various types of inking systems have been proposed; for example, one form of inking system is used in which an ink supply roller is in continuous contact with a ductor roller see, for example, M.A.N.-Druckmaschinen-Nachrichten, issue 62, pp. 3 to 18, especially FIG. 14. Another type of construction uses intermittent ink supply, in which the ink supply roller is placed cyclically in contact with the ductor roller, see, for example, FIG. 6 of the aforementioned literature or, for example, German Pat. No. 1,093,804.

If the subject matter is to be printed on paper webs of small format, for example on sheets of lesser width than the printing machine, or on narrow strips in a rotary offset printing machine, then wetting liquid, typically water, which reaches the ink train has the tendency to spread over the entire width of the ink rollers. The wetting liquid will thus be applied over substantial regions, at the edges or lateral portions of the rollers. An excess of water will occur in the inking system which, particularly at the end regions, will lead to a water-ink emulsion with an excess proportion of water. This leads to toning, or poor printing and, additionally, the supersaturated water-ink emulsion has the tendency to splash or spray off as the rollers rotate.

Intermittently operating ductor inking systems, under normal, ordinary operating conditions, usually are not subject to this difficulty since the intermittently operating ductor can return water-ink emulsion back to the ink trough or ink well. The quantity of water-ink emulsion which is returned usually is small, however, since it is proportional to the quantity of the ink being supplied to the ink supply roller of the inking system. If then, for example, printing is to be effected on a paper substrate which is narrower than the maximum printing width of the machine, or if subject matter has to printed which requires only very little ink, then an excess water condition can also result in an intermittently operating inking system, leading to toning.

The Invention. It is an object to improve the inking system such that toning is essentially avoided, and that spraying of water-ink emulsion is substantially eliminated.

Briefly, a return roller is provided to receive water-ink emulsion which will arise or build up in the ink train, and a stripping arrangement cooperates with the return roller to strip off the emulsion building up on the return roller, and return it to the ink trough or ink well. The stripping arrangement may be in form a counter-rotating roller which may be the ductor roller itself; or in form of doctor blades, or the like.

The system thus provides for return of the water-ink emulsion which builds up on the portion of the rollers which do not have a printing function to the ink well or ink trough itself, so that occurrence of an excess water condition in the non-printing zones is effectively avoided.

Drawings, illustratings examples of preferred embodiments:

Figure 1:
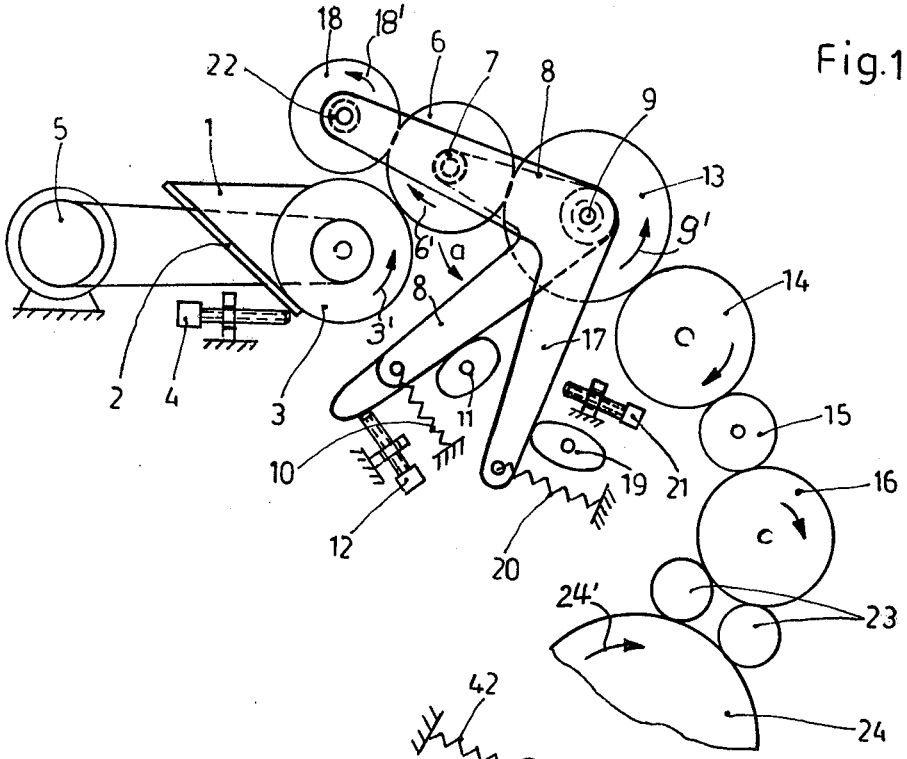
FIG. 1 is a schematic side view of a first embodiment of an inking system.
Figure 8:
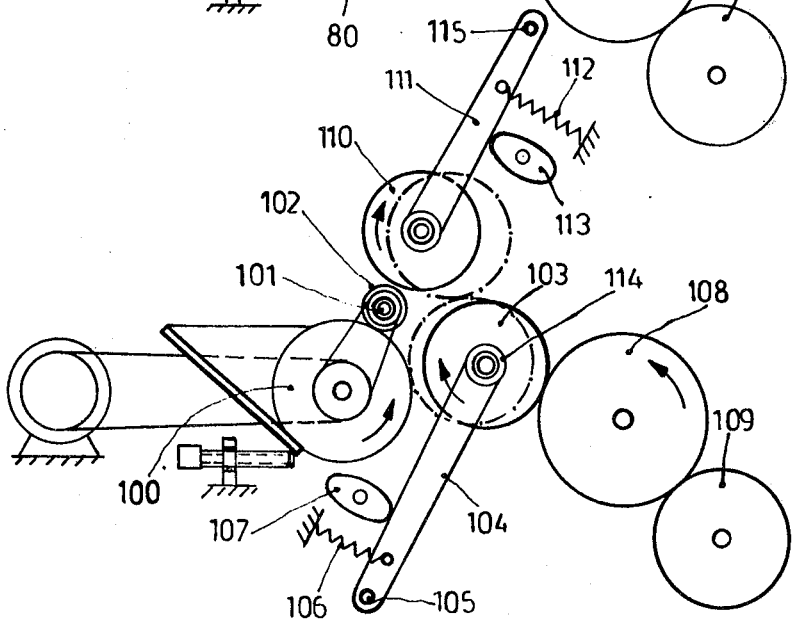

and FIG. 8 is a side view of a sixth embodiment corresponding to the illustration of FIG. 1.

General system, and embodiment of FIG. 1: An ink well or ink trough 1 applies ink to a ductor roller 3. A doctor blade 2, adjustable along its length by longitudinally staggered screws 4 controls the gap between the doctor blade 2 and the circumference of the ductor roller 3. The ductor roller 3 is driven from a drive motor 5 of controllable speed, to provide a surface speed of the ductor roller which is substantially less than the surface speed of the printing plate cylinder 24. The ductor roller need not be driven continuously; a ratched drive to provide for stepped movement of the ductor roller 3 is also suitable.

Ductor roller 3 cooperates with a main ink supply roller 6. Both the ductor roller 3 as well as the main ink supply roller 6 have a metallic ink-accepting surface. The main ink supply roller 6 is journalled at its end in adjustable bearings 7. The bearings 7 may, for example, be double eccenter bearings retained, at each side, in an arm of a double-arm lever 8. The lever 8 is pivotable about a fixed axis 9. The arm of lever 8 remote from the bearings 7 is biassed by a spring 10 against a cam 11 which has two cam projections or lands. The cam 11 rotates with a speed proportional to the printing machine operating speed. A set screw 12 provides for an adjustable limit regarding pivoting of the lever 8 in the direction of the arrow a.

The ink supply roller 6 is in continuous surface engagement with an ink transfer roller 13 of the ink train of the system. Ink transfer roller 13 has an elastic surface, for example made of hard rubber. It is journalled in bearings 9 which are fixed in the frame (not shown) of the printing machine. The center of the bearings 9 also forms the pivot axis for the lever 8, so that lever 8 and ink transfer roller 13 can rotate about the same axis. A further roller 14 is connected downstream, in the direction of ink transfer, to the roller 13. Roller 14 has an ink-accepting metallic surface and is formed as an axially oscillating friction roller to provide for spreading of ink on the transfer roller 13. Further rollers 15 and 16 are provided, in which the roller 16 is formed as an axially oscillating roller. Both rollers 14 and 16 are positively driven in circumferential direction, at a surface speed which corresponds roughly to the surface speed of the plate cylinder. The two ink application rollers 23 which provide ink to the plate cylinder 24, as well as the remaining rollers of the inking system, for example roller 15, are rotated by frictional surface engagement with adjacent rollers.

The direction of rotation of the respective rollers is shown by arrows which have been given the same reference numerals as the respective rollers, with a prime notation; thus, plate cylinder 24 operates in the direction of arrow 24'; ductor roller 3 in the direction of arrow 3'; etc.

A pivot lever 17, forming a second lever, is journalled to pivot about the same axis as the bearing 9, so that the pivot axis of levers 8 and 17 as well as of roller 13 will be congruent. One arm of pivot lever 17 is in cooperating engagement with a pivot cam 19. Cam 19 is driven from the printing machine at a speed depending on the printing machine speed. Spring 20 holds lever 17 in engagement with cam 19; an adjustable stop set screw 21 limits the degree of excursion of lever 17 towards the right in FIG. 1, when cam 19 is rotated 90° with respect to the position shown. The end of pivot lever 17 remote from engagement with cam 19 carries a return roller 18. Return roller 18 is journalled in adjustable bearing 22. The return roller 18 has an elastic surface.

Levers 8, 17 are duplicated at the axially remote side of the rollers to support the respective rollers as shown. Only one of the levers requires the springs and cams for operation although, in a preferred form, cams 11, 19 and springs 10, 20 are likewise duplicated at the other axial end of the respective rollers, in engagement with the respective matching levers 8, 17.

Operation: FIG. 1 illustrates the position of the rollers when ink is to be applied to the ink supply roller 6. The rollers 3, 6, 13 and 14 are in surface engagement, and further in engagement with such other rollers of the ink train which are not shown, and which may be present. The pivot lever 17 is so constructed that it passes over the double eccenter 7 of the ink supply roller 6, so that the return roller 18 will remain in contact with the ink supply roller 6 independent of the position of the pivot lever 17. In the position shown, the ink supply roller 6, the ink transfer roller 13 and the return roller 18 are carried along by surface frictional engagement from the distribution roller 14. Accordingly, ductor roller 3 and the ink supply roller 6 are so adjusted with respect to each other that they touch each other only lightly.

When the cams 11, 19 rotate in a position 90° offset with respect to that shown in FIG. 1, the lever 8 will be moved counter the direction of arrow a, and the pivot lever 17 will move in the direction of the arrow a under the spring force of tension spring 20. Consequently, the ink supply roller 6 will be lifted off from the ductor roller 3, while maintaining surface engagement with respect to the ink transfer roller 13. Simultaneously, the return roller 18 is brought in light surface contact with the ductor roller 3 for a short period of time, while maintaining contact with the ink supply roller 6. The bearings are so adjusted, and the adjustment set screw 21 so set that the return roller 18 and the ductor roller 3 have a very narrow, tiny gap between each other, in the order of about 0.03 to 0.05 mm when placed in the water-ink emulsion return mode. The water-ink emulsion will be stripped off the return roller 18 by the counter rotating ductor roller 3. The water-ink emulsion builds up on the return roller 18 due to return transport of this emulsion through the various rollers of the ink train of the inking system. As the cams 11, 19 continue to rotate and reach the position shown in FIG. 1, the remaining rollers will again likewise reach that position, and ink can be supplied to the ink supply roller 6 from the ink ductor roller 3, for further transfer and transport through the rollers of the ink train, for example ink transfer roller 13, and the other ink train rollers 14, 15, 16, 23. In those zones which do not have printed subject matter thereon, the ink will still be split between the rollers and an water-ink emulsion will build up on the ink supply roller 6 as well as on the other rollers of the ink train. In the zones to be printed, ink will be transported in forward direction to the plate cylinder; in the zones in which no printing is to take place, a return transport of a water-ink emulsion towards the ductor roller 3 will result. The necessary width of the gaps between the rollers 3, 6, 13 and 18 can be adjusted by setting or adjusting the position of bearing 7 for ink supply rollers 6 and 22 for the return roller 18, and of the adjustment set screws 12 and 21. The return roller 18 can also be journalled in such a manner that it alternately comes into engagement with the ductor roller 3 and the ink supply roller 6.

Figure 2:
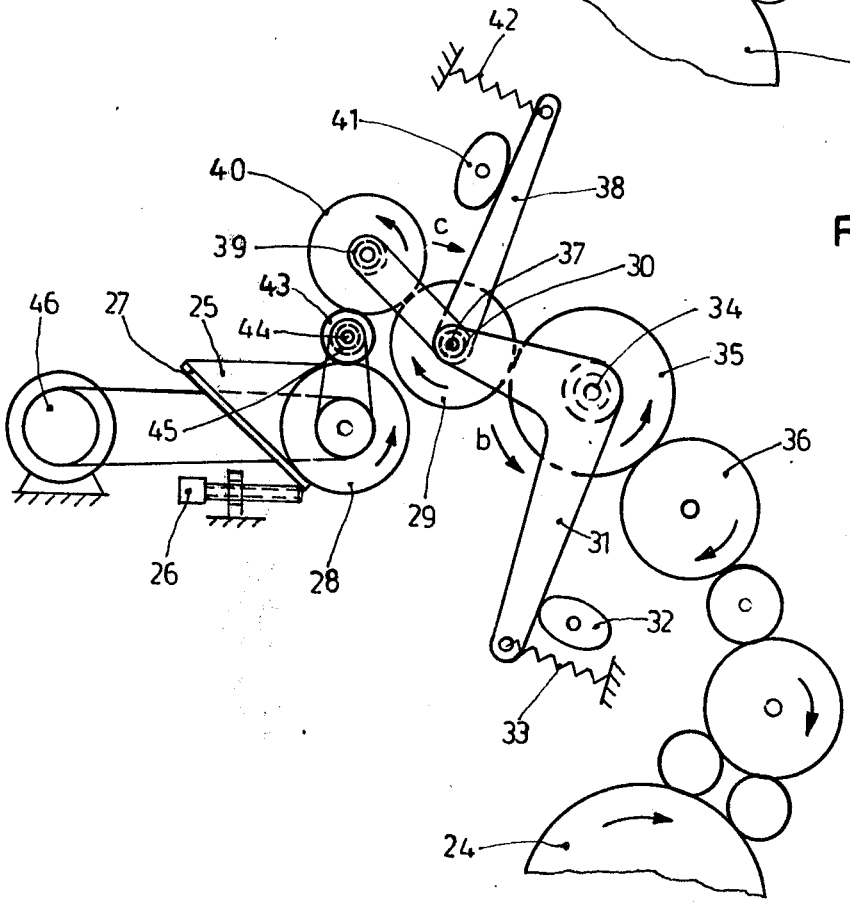
FIG. 2 is a side view of a second embodiment.

Embodiment of FIG. 2: An ink well 25, with an adjustable doctor blade 27 therein, has a ductor roller 28 rotatably secured in the ink well. The longitudinal zones of the doctor blade 27 are adjustable by set screws 26, so that the gap between the doctor blade 27 and the ductor roller 28 can be adjusted in transverse zones. The ductor roller 28 cooperates with an ink supply roller 29 having an ink-accepting metallic surface. The ink supply roller 29 is journalled in adjustable bearings 30 at both of its axial ends. Bearings 30 may be double eccenter bearings, each respectively secured to a pivot lever 31. One of the pivot levers 31 at one side can pivot about the axis of shaft 34 under control of a cam 32. Cam 32 is driven from the main drive of the printing machine. The lever 31 is maintained in engagement with cam 32 by spring 33. The axis of the bearing 34, retaining transfer roller 35, also forms the pivot axis for lever 31. Transfer roller 35 has an elastic surface, for example hard rubber, and is in engagement with the ink supply roller 29 on the one hand and, on the other, with a roller 36 of the ink train, to supply ink to the further rollers of the ink train. The roller 36 has a metallic, ink-accepting surface and is journalled as a friction roller for both rotary as well as axial movement. The roller 36 is driven from the printing machine by means well known, for example gears secured to the shaft of roller 36, and not further described or shown since any suitable drive well known in the art may be used.

The lever 31 is further attached to a second lever 38. Second lever 38 is pivotably secured to the bearing 37, to rotate about the axis of bearing pin 37. Lever 38 is a double-arm lever; one arm of lever 38 terminates in a bearing 39 which, preferably, is adjustable. Bearing 39 forms the journal for the return roller 40. Return roller 40 has a metallic, ink-accepting surface. The other arm of the lever 38 is in engagement with a cam 41, driven from the main drive of the machine. A spring 42 maintains engagement between lever 38 and cam 41. The stripper roller 43 has an ink-accepting metallic surface, and is journalled on a shaft 44 held in bearings 45 which are adjustable in the frame of the machine, or another fixed position. The shaft 45 of the stripper roller 43 is connected to a pulley 49 (FIG. 3) which provides a positive drive to the stripper roller 44 at a circumferential surface speed which corresponds to the surface speed of the ductor roller 28. A belt, for example a V-belt or the like, connects the pulley 45 to the drive for ductor roller 28. The stripper roller 43 is in continuous engagement with the ductor roller 28 which is continuously rotating at slow speed, driven from motor 46. The engaging positions are shown in FIG. 2.

The stripper roller 43 can be continuous, or can include a plurality of roller sections 47 (FIG. 3) secured to the shaft 44 by selectively removable axial attachment elements 48. After removing the attachment elements 48, roller sections 47 can be added to, or removed from, shaft 44. The roller sections 47 are provided in zones and are located, with respect to the width of the machine, in those zones where no printing is to take place, that is, in those zones which then necessarily will have a greater collection of water or other wetting liquid appear thereat.

Operation, with reference to FIG. 2: The return roller 40 is in engagement with the various sections of the stripper roller 43. The sections 47 of the stripper roller remove the water-ink emulsion applied to the return roller 40 and apply that water-ink emulsion back on the ductor roller 28. The return roller 40 acts as an outer idler roller with respect to the ink in the range of the zones where printing is to take place. Thus, continuous contact with the stripper roller 43 is not disadvantageous regarding influencing of the ink film in the range of the zones where printing is actually to take place, because the sections 47 on the stripper roller are located in those regions where printing is not to take place.

Upon rotation of cams 32 and 41 from the position shown in FIG. 2 by 90°, the double-arm lever 31 is moved in the direction of the arrow b, whereas the lever 38 is moved in the direction of the arrow c. Movement of lever 31 in the direction of the arrow b engages the ink supply roller 29 with the ductor roller 28. Simultaneously, due to the movement in the direction of the arrow c, the return roller 40 is lifted off the stripper roller 43. Since the pivot axis of lever 38 is coincident with the axis of rotation of the ink supply roller 29, the return roller 40 will continue to remain in contact with the ink supply roller 29 and therefore can accept, in the zones where printing is not to take place, the water-ink emulsion which will form thereon continuously, and without interruption.

The stripping effect, thus, is obtained by the stripper roller 43 which rotates in counter-rotary direction with respect to the return roller 40, as is clearly apparent from the arrows in FIG. 2 showing the direction of rotation of the respective rollers. In FIG. 1, the direction of rotation of the ductor roller 3 and of the return roller 18 are opposite each other; in FIG. 2, the stripper roller 43 is additionally interposed, and formed with the stripping segments as shown, for example, in FIG. 3, to print on a carrier or substrate which has lesser width than the overall width of the machine, and which is positioned centrally with respect to the web path of the printing machine.

Figure 4:
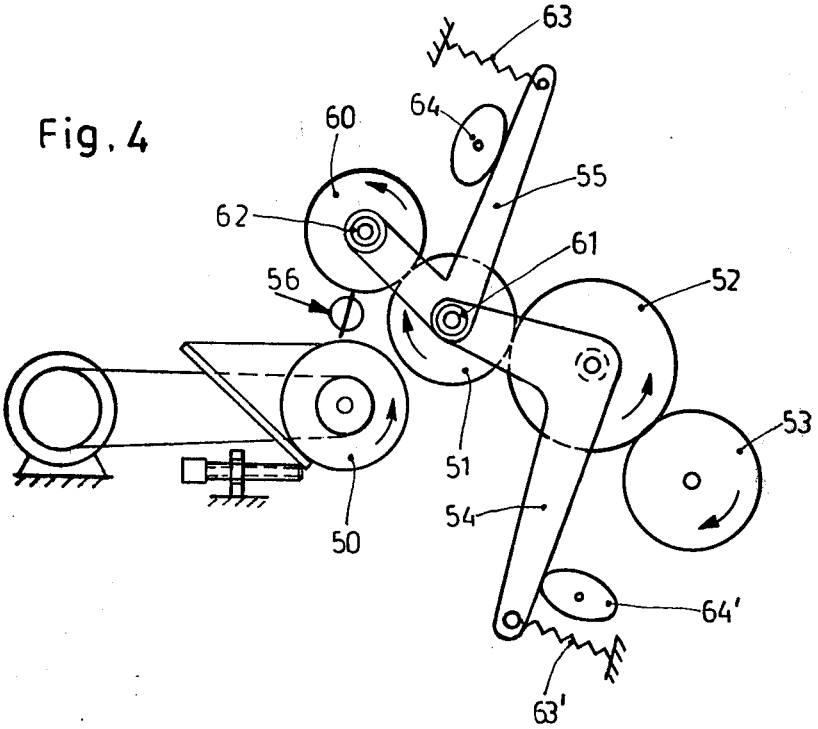
FIG. 4 is a fragmentary side view of a third embodiment, and drawn to correspond to the illustration of FIG. 1.
Figure 5:
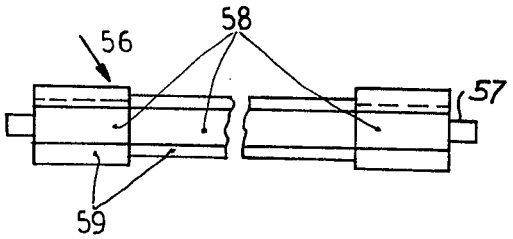
FIG. 5 is a front view of a stripping element used in the system of FIG. 4.

Embodiment of FIG. 4: Ductor roller 50 is operable in an ink well, and associated with a doctor blade, similar to the preceding embodiments. An ink supply roller 51 and ink train rollers 52, 53 are shown, operative similar to the embodiment of FIG. 2. The main ink supply roller 51 is journalled in adjustable bearings 61 and can be driven by positive drive with the same, or essentially the same, circumferential speed as roller 53 and, hence, eventually plate cylinder 24. The difference between the embodiments of FIGS. 2 and 4 lies in the stripper arrangement. Rather than using the stripper roller 43 of FIG. 2, a stripper blade 56 is provided. Stripper blade 56 is secured to a shaft 57 on which a plurality of fixed carriers 58 are attached, secured against relative rotation with respect to the shaft of stripper 56. The shaft 57 of the stripper 56 is secured in suitable machine bearings so that it cannot rotate with respect thereto. Each one of the blade carrier elements 58 has a doctor blade 59 attached thereto. By adjusting the relative rotation of the carriers 58 with the blades 59 thereon with respect to the shaft 57 of the stripper 56, it is possible to adjust the edge of the doctor blade segments 59 with respect to the surface of the return roller 60. The return roller 60 is journalled in adjustable bearing 62 on a lever 55 which can pivot about the axis of the bearing 61, coincident with the axis of the shaft of ink supply roller 51. The pivoting paths of the levers 54, 55 are determined by cams 64, 64'. Springs 63, 63' hold the levers in engagement with the respective cams. The extent of pivoting movement can be determined or limited by suitable abutment screws or other adjustable abutment element, similar to the showing with respect to FIG. 2. It is also possible to fit the blade 57 throughout with segmental carrier elements 58 with doctor blades 59 thereon and rotate those segments 58 to be 90° offset with respect to the illustration in FIG. 4 which are to become ineffective, for example, in the center of the longitudinal extent of shaft 57, as shown in FIG. 5. Thus, those doctor blades 59 which are not to remove a water-ink emulsion from the return roller 60 can be twisted 90° with respect to the illustration in FIG. 4.

Operation: Water-ink emulsion is scraped or stripped off the return roller 60 from those regions where the stripping blades 59 are in engagement with the surface or with the film on the return roller 60, when the stripper 56 is placed in the position shown in FIG. 4. The water-ink emulsion is returned to a greater extent to the ink well in which ductor roller 50 operates than in the embodiment of FIG. 2, since the blades 59, which may be slightly resiliently, can be placed in direct engagement with the surface of the return roller 60. In all other respects, the operation of the embodiment of FIGS. 2 and 4 is similar.

Figure 6:
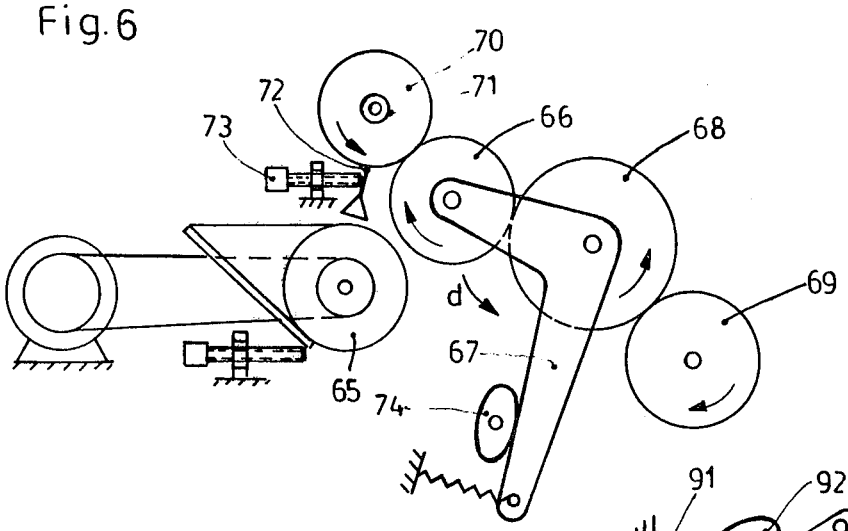
FIG. 6 is a side view of a fourth embodiment, corresponding to the illustration of FIG. 1.

Embodiment of FIG. 6: The ductor roller 65 is positively driven from a motor. The ink supply roller 66 is movably supported on lever 67. An ink transfer roller 68 is provided, and a portion of the ink train represented by roller 69 is shown. The general arrangement can be similar to that described in connection with FIG. 1. The ink supply roller 66 can be driven either by friction from the ink train, that is, indirectly by surface friction engagement from roller 69, or can be driven positively directly from the machine drive, for example over gears, belts, sprocket chains, or the like. Roller 69, forming part of the ink train, would normally be positively driven.

In contrast to the previous embodiments, the return roller 70 is retained in bearings 71, fixed in the machine. Roller 70 has an elastic surface. The return roller 70 can cooperate with a fixed doctor blade 72 which can be adjusted by means of adjustment screws 73; a plurality of such adjustment screws 73 are provided along the axial length of the roller 70 to permit longitudinal adjustment of the engagement angle of the doctor blade 72, in axial zones, with respect to the roller 70. The doctor blade, together with the adjustment arrangement, is located above the ductor roller 65 so that an water-ink emulsion stripped off roller 70 can drip down into the ink well, by gravity, in which the ductor roller 65 operates.

Operation: FIG. 6 shows the arrangement in the position when the water-ink emulsion is to be returned to the ink trough or ink well. The ink supply roller 66 is in surface engagement with the transfer roller 68 and also in surface engagement with the return roller 70. Thus, water-ink emulsion is transferred to the return roller 70 by splitting the surface film unto the return roller 70. Upon rotation of the cam 74, lever 67 is moved in the direction of the arrow d so that the ink supply roller 66 is lifted off the fixedly journalled return roller 70 and brought in contact with the ductor roller 65. Ink is transferred to the ink supply roller 66 thereby, as customary.

Figure 3:
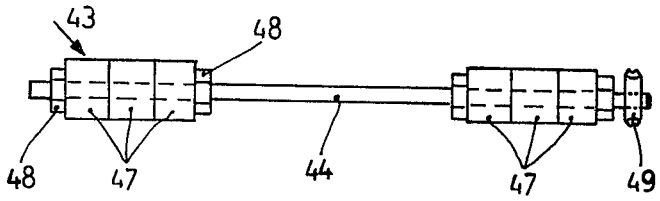
FIG. 3 is a front view of a sectionalized stripping roller.
Figure 7:
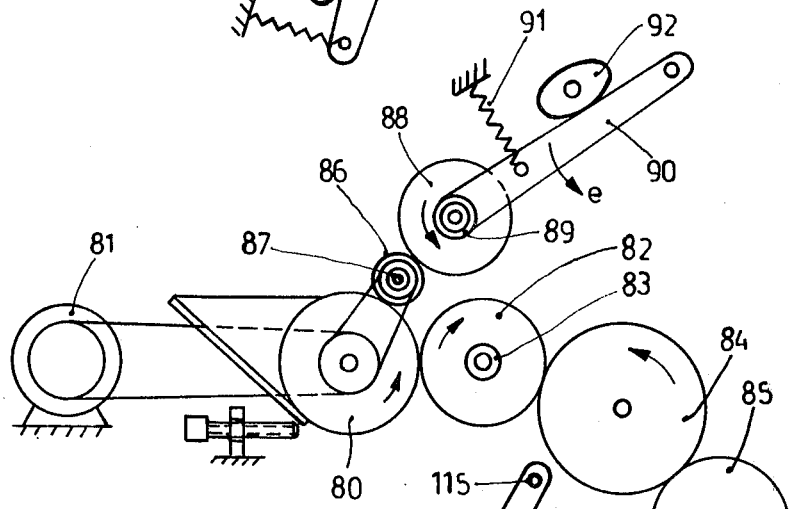
FIG. 7 is a side view of a fifth embodiment corresponding to the illustration of FIG. 1.

Embodiment of FIG. 7: A ductor roller 80 is driven by positive drive from a motor 81 or, alternatively, directly from the printing machine. The ductor roller 80 is driven at approximately the same surface speed as that of the plate cylinder of the machine. The ductor roller 80 is in continuous contact with the ink supply roller 82. Ductor roller 80 and ink supply roller 82 have metallic surfaces. The ink supply roller 82 is journalled in an adjustable bearing 83. The ink supply roller 82 is in engagement with a transfer roller 84. An axially oscillating ink train roller 85 is in engagement with transfer roller 84. Other transfer and ink distribution or oscillating rollers can be provided, as well known. The ductor roller 80 is in engagement with a positively driven stripper roller 86. Stripper roller 86 is driven at approximately the same surface speed as that of ductor roller 80. Stripper roller 86 can be formed similar to the roller 43 (FIG. 3). The stripper roller 43 can also be driven directly by surface engagement with the ductor roller 80. A return roller 88 is provided which is journalled in adjustable bearings 89 which are secured to levers 90. Two such levers and bearings are provided for the return roller 88, one at each axial end thereof. In a preferred form, the ink supply roller 82 is positively driven in order to prevent changes in the surface speed upon start-up of the return roller. The lever 90 is in engagement with a cam 92, held thereagainst by a spring 91.

Operation, embodiment of FIG. 7: As shown in the figure, the return roller 88 is in engagement with the stripper roller 86 and, consequently, the water-ink emulsion which built up at the lateral sides and along the edges of the return roller 88 will be stripped off that roller, and returned to the ductor 80. Upon rotation of cam 92, lever 90 is moved in the direction of the arrow e, bringing the return roller 88 into contact with the ink supply roller 82 and lifting it off contact from the stripper roller 86. The return roller 88 is driven by surface friction with the respective roller with which it is in engagement, that is, main ink supply roller 82, when the cam 92 has rotated. By transfer from the main ink supply roller 82, that is, by splitting of the film thereon, water-ink emulsion is transferred to the return roller 88 which, upon continued rotation of cam 92 and positioning of roller 88 in the location shown in FIG. 7, can be stripped off by the stripper roller 86.

Embodiment of FIG. 8: A ductor roller 100, which has a metallic surface and is slowly driven, is in engagement with a metallic stripper roller 102. The stripper roller, preferably, can be removed as an entire unit from the inking system for replacement by different stripper rollers in which the segments extend over different longitudinal zones than those of another roller, as explained, for example, in connection with the roller 43 (FIG. 3). A main ink supply roller 103 cooperates with the ductor roller 100. The two axial ends of the ink supply roller 103 are secured in adjustable bearings 114 which are located in respective levers 104. The levers 104 pivot about a shaft axis 105. They are held in engagement with a cam 107 by a spring 106. The cam 107 is driven from the main machine drive. The ink supply roller 103 cooperates with a transfer roller 108 which has a somewhat yielding surface, for example hard rubber, which, in turn, is in engagement with an ink train roller 109 having a metallic surface. The ink train roller 109 is positively driven at the same surface speed as that of the plate cylinder, at least approximately.

A return roller 110 is located above the rollers 102, 103, journalled with its axial ends in a lever 111. Lever 111 is pivotable about an axis 115 and held in engagement with a cam 113 by spring 112.

Operation, embodiment of FIG. 8: The position illustrated is that one which the arrangement assumes when the water-ink emulsion is returned to the ductor roller 100. The return roller 110 is in engagement with stripper roller 102 which will remove the water-ink emulsion from those zones of the return roller 110 where the stripper roller is provided with roller segments. The ink supply roller 103 is in engagement with the transfer roller 108.

Upon rotation of both cams 107, 113, driven by the machine, the return roller 110 is lifted off from the stripper roller 102 and, simultaneously, the main supply roller 103 is removed from the ink transfer roller 108 and brought into engagement with the ductor roller 100. When the main ink supply roller 103 comes in contact with the ductor roller 100, the return roller 110 will also be in contact with the main ink supply roller 103, as indicated by the chain-dotted circles in FIG. 8. Thus, on the one hand, ink is supplied from the ductor roller 100 to the main ink supply roller 103 while, simultaneously, the ink return roller takes off water-ink emulsion from those zones of the main ink supply roller 103 where printing is not to be effected. The central zone, for example, of the ink return roller will then operate merely as an idler portion.

Many changes and modifications may be made. For example, additional and well-known adjustment elements such as, for example, adjustable stops and the like, bearing positions and eccenters can be used to set the engagement position, engagement distances and engagement pressures of the respective rollers with respect to each other, and/or with respect to the stripper roller, for example stripper roller 86 (FIG. 7) or stripper blade 72 (FIG. 6) if used. Other changes and modifications may be made, and the detailed construction of the ink system may be varied or designed as required. The system illustrated in FIGS. 1 and 2 is usually sufficient for most printing systems; a greater or lesser number of transfer rollers, axially oscillating rollers and the like may be used, as desired, and required by results to be obtained, in the light of the economics of construction of the machine.

I claim:

1. Inking system for a lithographic offset printing machine, said printing machine having a plate cylinder that is supplied with a wetting liquid, said inking system having a ductor roller (3, 28, 50, 65, 80, 100) and ink well means (1, 2, 4; 25, 26, 27) supplying ink to the ductor roller;

an ink supply roller (6, 29, 51, 66, 82, 103) located in ink-accepting position with respect to the ductor roller and receiving ink from the ductor roller;

ink transfer roller means in ink-transmitting relationship to the ink supply roller and transferring ink from the ink supply roller to the plate cylinder (24) of the printing machine, and comprising, in accordance with the invention, means removing ink-wetting liquid emulsion from the ink supply roller which builds up in operation of the machine on the ink supply roller by feedback from the plate cylinder including a return roller (18, 40, 60, 70, 88, 110) in ink-wetting liquid emulsion receiving relationship with respect to the ink supply roller, and stripper means (3, 43, 56, 72, 86, 102) located in ink-wetting liquid emulsion stripping relationship with respect to the return roller and positioned to return the stripped-off emulsion of ink and wetting liquid to the ink well means.

2. System according to claim 1, including means (5) driving the ductor roller in a direction of rotation counter the direction of rotation of the return roller to strip ink from the return roller by the ductor roller upon mutual engagement thereof due to the opposite directions of rotation of the ductor roller (3) and the return roller (18), the counter-rotating ductor roller forming said stripper means.

3. System according to claim 1, wherein the stripper element comprises a doctor blade (56, 72) located above the ductor roller.

4. System according to claim 1, wherein the stripper means comprises a stripper roller (43, 86, 102) having a metallic surface in engagement with the ductor roller.

5. System according to claim 1, wherein the return roller has an elastic surface.

6. System according to claim 1, wherein the ductor roller and the ink supply roller, each, have an ink-accepting metallic surface.

7. System according to claim 1, further including means movably journaling the return roller, said movable journaling means cyclically moving the return roller in engagement with the stripper means and out of engagement with the stripper means.

8. System according to claim 7, wherein the movable journaling means for the return roller is journaled about an axis of rotation to maintain contact between the return roller (18, 40, 60) and the ink supply roller upon movement of said movable journaling means.

9. System according to claim 7, wherein the movable journaling means move the return roller (88, 110) between the stripper means (86, 102) and the ink supply roller (82, 103) in cyclical engagement - disengagement movement.

10. System according to claim 7, wherein said ink transfer roller means includes an ink transfer roller and wherein the movable journaling means for the ink supply roller (6, 29, 51, 66) move the ink supply roller about an axis of rotation coincident with the axis of rotation of said ink transfer roller.

11. System according to claim 7, wherein said ink transfer roller means includes an ink transfer roller and wherein said movable journaling means move the ink supply roller (103) between the ductor roller (100) and said ink transfer roller.

12. System according to claim 7, wherein said ink transfer roller means includes an ink transfer roller and wherein said ink supply roller (82) is fixedly journaled in the printing machine and is in surface contact engagement with the ductor roller (80) and said ink transfer roller (84).

13. System according to claim 1, wherein the return roller is in continuous engagement with the stripper means (72);

and movable journaling means (67) are provided, journaling the ink supply roller (66) and moving the ink supply roller, cyclically, in cyclical engagement and disengagement with the ductor roller (65).

14. System according to claim 1, wherein the nip or gap between the stripper means and said return roller is adjustable.

15. System according to claim 1, wherein the stripper means includes a stripper element extending axially essentially parallel to the return roller and located in ink-wetting liquid stripping relationship to said return roller with respect to portions or zones of lesser extent than the full axial length of return roller only.

16. System according to claim 15, wherein the stripper means comprises a stripper roller (43) having a shaft (44) extending essentially the full width of the return roller (40), and stripper roller sections (47) of substantially lesser axial length than said shaft positioned on said shaft to provide for engagement of said stripper roller with the return roller over said zones or portions only.

17. System according to claim 16, wherein the stripper means comprises a stripper element extending axially essentially along the length of and parallel to the return roller, said stripper element being replaceably located in the printing machine.

18. System according to claim 15, wherein the stripper means comprises a stripper blade (56, 72) extending essentially parallel to the return roller, said stripper blade being subdivided into axially extending zones, and means (73) adjusting the engagement of said blade, in respective zones, with respect to the return roller.

19. System according to claim 1, wherein the supply roller is positively driven from the drive of the printing machine.

20. System according to claim 1, wherein said ink supply roller is journaled for alternate engagement with said ductor roller or said ink return roller.

21. System according to claim 1, wherein said ink return roller is journaled for alternate engagement with said ductor roller and said ink supply roller.

* * * * *